US005199579A

United States Patent [19]

Van Duyne

[11] Patent Number: 5,199,579

[45] Date of Patent: Apr. 6, 1993

[54] ATTACHING DEVICE FOR VARIABLY POSITIONABLE DISPLAY SHELF

[75] Inventor: Frederick H. Van Duyne, Ringwood, N.J.

[73] Assignee: Melrose Displays, Inc., Passaic, N.J.

[21] Appl. No.: 844,752

[22] Filed: Mar. 2, 1992

[51] Int. Cl.[5] ..... A47F 5/08

[52] U.S. Cl. ..... 211/90; 211/187; 211/175; 108/108

[58] Field of Search ..... 211/187, 90, 134, 175; 248/242; 108/108, 107

[56] References Cited

U.S. PATENT DOCUMENTS

| | | | |
|---|---|---|---|
| 3,101,923 | 8/1963 | Streater | 211/187 X |
| 3,182,945 | 5/1965 | Sedo | 211/187 X |
| 3,199,821 | 8/1965 | Story | 211/187 X |
| 3,234,897 | 2/1966 | Berk | 108/108 X |
| 3,248,079 | 4/1966 | Kennedy | 211/187 X |
| 3,346,226 | 10/1967 | Shell | 248/242 |
| 3,572,626 | 3/1971 | Bertschi | 248/242 |
| 3,701,325 | 10/1972 | Fenwick | 108/108 X |
| 4,307,671 | 12/1981 | Albano | 248/242 X |
| 4,378,925 | 4/1983 | Griffin | 211/187 X |

*Primary Examiner*—Blair M. Johnson
*Attorney, Agent, or Firm*—Siegmar Silber

[57] ABSTRACT

A multiposition shelf attaching is disclosed, which device is adapted for use with shelving standards or with wire-grid walls. The device is a wire formative and is constructed from either a round or a square wire extrusion. The anterior portion of the device, when installed in a first position, that is, usually with the shelf-being-attached horizontal (or normal to the face plane of the grid or standard), lies in a plane substantially parallel to the face plane. The posterior portion has two or more clips or stops connected serially to the anterior portion. Each clip has a load-bearing portion and a descender portion connected at substantially right angles to the load-bearing portion. When installed, the load-bearing portion of the selected clip means rests upon the lower edge of the opening in the standard or grid and the descender abuts the rear plane thereof. The first in the series of clips may be dimensioned to hold the shelf horizontally with the descender thereof substantially parallel to the anterior portion. The successive stops tilt the shelf downward to the extent limited by the dimensions of the wire form and the dimensions of the bracket. The wire form is dimensioned so that the draft required for placement within the standard is less than the opening therewithin.

20 Claims, 2 Drawing Sheets

ATTACHING DEVICE FOR VARIABLY POSITIONABLE DISPLAY SHELF

BACKGROUND OF THE INVENTION

1. Field of the Invention

This invention relates to a retail display unit that includes a variably positionable shelf, and more particularly, to an attaching device therefor, especially one constructed from a wire formative. The attaching device is incorporated into a shelf bracket in a manner that enables the retailer to alter the position of the shelf without requiring loading and unloading of merchandise stored thereon.

2. Information Disclosure Statement

In preparing for this application, a pre-examination, patentability search of U.S. and foreign patents was conducted. In performing the search, the following fields were examined:

| CLASS/SUBCLASS | |
|---|---|
| 211/187 | U.S. only |
| 248/242, 249, 302, 303 | U.S. and foreign |

Upon search, the following patents were uncovered:

| U.S. Pat. No. | Inventor | O.C. | Issue Date |
|---|---|---|---|
| 279,810 | A. Richards, Sr. | 248/302 | 06/19/1883 |
| 449,134 | C. Porter | 248/249 | 03/31/1891 |
| 597,016 | McC. H. Parker | 211/59.1 | 01/11/1898 |
| 1,200,361 | W. M. Johnson et al. | 248/302 | 10/03/1916 |
| 1,898,781 | H. H. Leiter | 248/302 | 02/21/1933 |
| 2,797,058 | A. J. H. Packham | 248/302 | 06/25/1957 |
| 3,133,147 | E. C. Auld Jr. et al. | 248/302 | 05/1.:/1964 |
| 3,167,287 | W. F. Collins, Jr. | 248/302 | 01/26/1965 |
| 3,220,680 | L. R. Williams | 248/302 | 11/30/1965 |
| 4,008,873 | Travaglio et al. | 248/242 | 02/22/1977 |
| 4,108,085 | C. G. Shepherd et al. | 108/108 | 08/22/1978 |
| 4,324,380 | Rothenberg | 248/302 | 04/13/1982 |

In considering the various patents uncovered, U.S. Pat. No. 4,108,085 to C. G. Shepherd et al., issued Aug. 22, 1978, discloses a display gondola with a perforated display panel on which either a light- or heavy-duty shelf can be supported. The heavy-duty shelf is shown with a two-position, sheetmetal bracket. U.S. Pat. No. 3,220,680 to L. R. Williams, issued Nov. 30, 1965, discloses a wire hose support with dual bends for frictional contact with washtub sides. While the configuration has some similarities to that shown in the present disclosure, the Williams '680 device is not a two-position bracket and there is nothing in the teaching thereof that would suggest combining in a manner to provide one. Other patents on the search were considered to be of interest only.

SUMMARY

In general terms, the invention disclosed hereby includes a multiposition shelf attaching device that is adapted for use with shelving standards or with wire-grid walls. The device is a wire formative and is constructed from either a round or a square wire extrusion. For descriptive purposes, the device is viewed as installed and the portion lying in front of the face plane of the standard or wire grid is termed the anterior portion; and, that rearward hereof, the posterior portion. The anterior portion, when installed in a first position, that is, usually with the shelf-being-attached horizontal (or normal to the face plane of the grid or standard), lies in a plane substantially parallel to the face plane. The posterior portion has two or more clips or stops connected serially to the anterior portion. Each clip has a load-bearing portion and a descender portion connected at substantially right angles to the load-bearing portion. When installed, the load-bearing portion of the selected clip means rests upon the lower edge of the opening in the standard or grid wall and the descender abuts the rear plane thereof. The first in the series of clips may be dimensioned to hold the shelf horizontally with the descender thereof substantially parallel to the anterior portion. The successive stop means cant or tilt the shelf downward to the extent limited by the dimensions of the wire form and the dimensions of the bracket. The wire form is dimensioned so that the draft required for placement within the standard is less than the opening therewithin. The advantage of this attaching hardware is that, in contrast to other multiposition shelf mounting arrangements, no disassembly is required and the shelf may remain loaded with product during the change from one position to another.

OBJECT AND FEATURES OF THE INVENTION

It is an object of the present invention to provide a multiposition shelf bracket that is economical to manufacture.

It is a further object of the present invention to provide a multiposition shelf bracket using either round or square wire for the attachment portion thereof.

It is yet another object of the present invention to provide a two-position shelf bracket that is compatible with the openings in the standards of display units.

It is a feature of the present invention that the shelf attached thereby can be readily shifted from one position to another.

It is another feature of the present invention to enable a shift in shelf position without requiring the previous unloading of material stored on the shelf.

Other objects and features of the invention will become apparent upon review of the drawings and the detailed description which follow.

BRIEF DESCRIPTION OF THE DRAWINGS

In the following drawings, the same parts in the various views are afforded the same reference designators.

DESCRIPTION OF THE PREFERRED EMBODIMENT

Figure 1:
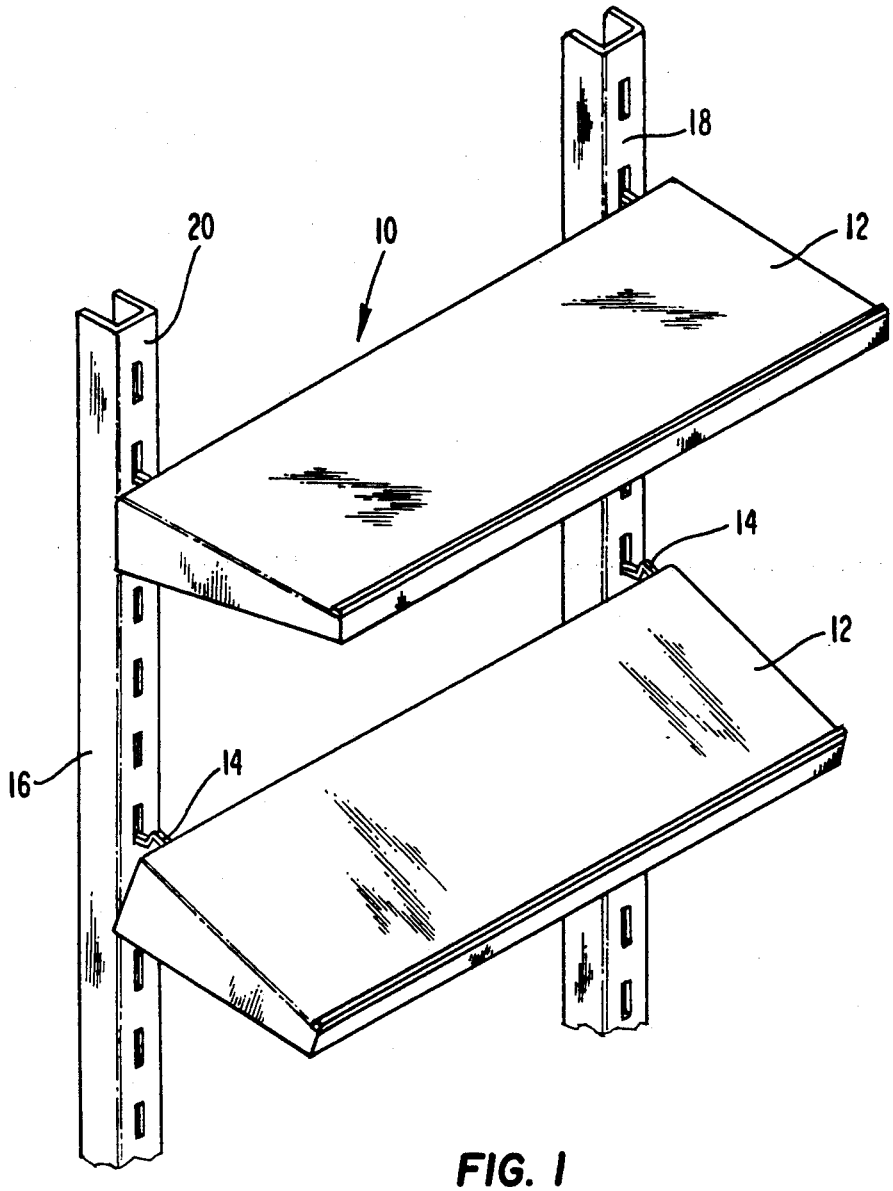
FIG. 1 is a front perspective view of a retail display unit having a variably positionable shelf mounted using an attaching device of the present invention, said view partially breaks away a portion of an upright standard of the display unit to show the attaching device.
Figure 2:
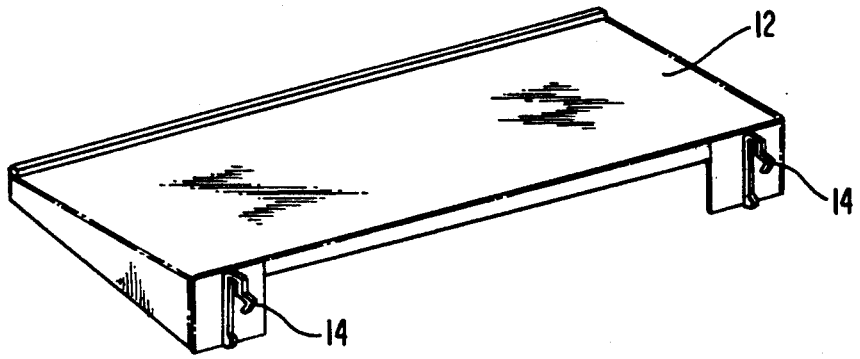
FIG. 2 is a rear perspective view of a square wire bracket and shelf assembly of the invention shown in FIG. 1.
Figure 3:
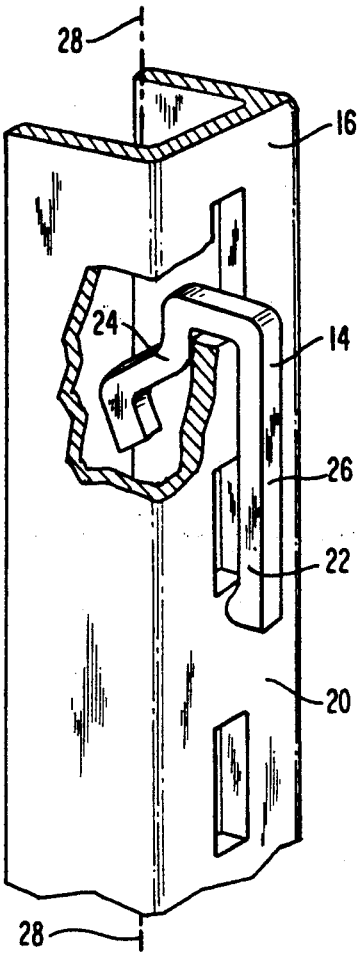
FIG. 3 is a detailed view of the attaching device of the invention, which view shows the relationship between the opening in the upright standard and the device in the first position.
Figure 4:
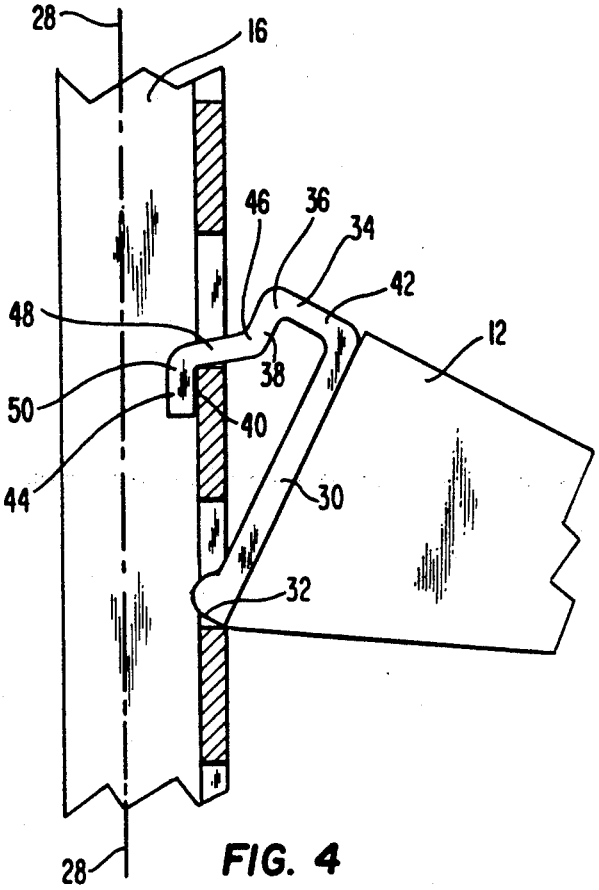
FIG. 4 is a detailed view of the attaching device of the invention, which view shows the relationship between the opening in the upright standard and the device in the second position; and, FIG. 5 is an operational view showing the draft required during repositioning of the shelf for passage of the attaching device of the invention, said passageway required is shown in phantom.

This invention is first described with reference to the best mode thereof wherein the invention is shown in connection with a retail display unit. Referring to FIG. 1, a perspective view of a retail display unit is shown and is indicated by the reference designator 10. The unit 10 has a variably positionable shelf 12 mounted thereon. An attaching device 14 of the present invention is seen in FIG. 1 where the view partially breaks away a portion of an upright standard of the display unit 10. The unit 10 is constructed to include at least two standards 16 and 18 and, upon installation, these standards are arrayed in a substantially vertical position. The face of each standard defines a face plane 20. This face plane is used for descriptive purposes to define in a functional manner the portions of the attaching device.

Referring now to FIGS. 1 through 4, the attaching device 14 is shown in detail. Although the attaching device 14 is shown constructed from square wire, the device would function equally well if it were constructed from a round or other wire extrusion. With the shelf 12 mounted in a substantially horizontal position, the portion of the attaching device forward of the face plane 20 is generally referred to as the anterior portion 22; and that rearward thereof, as the posterior portion 24. The anterior or stabilizer portion 22 is constructed with a bracket connector portion 26 which, with the shelf supported thereby installed in a substantially horizontal manner, lies on face plane 20 and parallel to the longitudinal axis 28 of standard 16. The bracket connector portion 30 is dimensioned so that, with the shelf 12 in second position—usually tilted downwards approximately 17 degrees from horizontal, the face end 32 fits into an opening in the standard 16. The captive end 34 of the anterior portion 22 is continuous with the captive end 36 of the posterior portion 24. The bracket connector portion 30 is, in turn, attached to shelf 12 by spot welding or other suitable connection means. The posterior portion 24 is shown with two clips or stop means 38 and 40. The first stop means 38 connects to the captive end 36 of the anterior portion 22 and, with respect to shelf 12, extends rearwardly and downwardly therefrom. When installed in the standard 16, the rearward extending or upper portion 42 of stop means 38 becomes load bearing, and the descending or lower portion 44 of stop means 38 prevents forward movements of the shelf 12. Likewise, the second stop means 40 connects to the lower end 46 of stop means 38 and, with respect to the shelf 12 in the second position, extends rearwardly and downwardly therefrom. When installed in the standard 16 in the second position, the rearwardly extending or upper portion 48 of stop means 40 becomes load bearing (to the extent of the downward force vector of the loaded shelf mounted at an angle), and the descending or lower portion 50 of stop means 40 prevents forward movement of the shelf 12 and is partially load bearing (to the extent of the horizontal force vector of the loaded shelf mounted at an angle). Optionally, the attaching device 14 can be dimensioned so that, in the second position, the free end 32 bears upon standard 16 in a manner to further distribute the load of the canted shelf. For display units of the type shown, it has been determined that the optimal slant or cant of the shelf is 17±5 degrees. Thus, the optimal angle between lower portion 44 of stop means 38 and upper portion 48 of stop means 40 is 107±5 degrees. Although the attaching device of this invention is shown with a series of two stop means, the design may be modified to extend the series of stops by adding additional one thereto.

Figure 5:
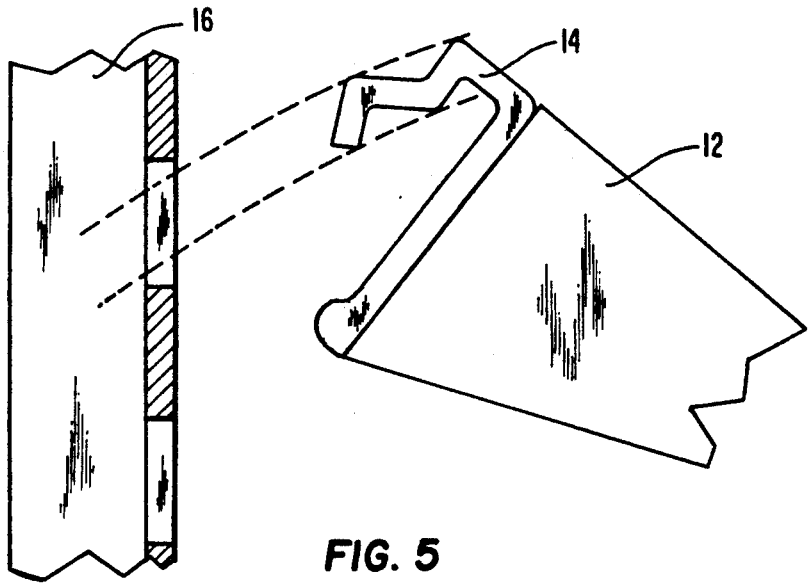

Referring now to FIG. 5, the draft or channel 52 is shown. The attaching device 14 is dimensioned so that the maximum height 54 of the envelope 56 about stop means 38 and 40 is within the dimensions of the clearance channel behind standard 16.

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed is:

1. An attaching device adjustably mounting a display unit shelf in any one of at least two positions onto said support surface having a face plane with predetermined openings therethrough, said attaching device comprising, in combination:

a wire formative attached to said shelf, when viewed with the shelf installed on one side of and substantially normal to said face plane, having an anterior portion on the shelf side of the face plane and a posterior portion, on the other side, and extending through one of said predetermined openings, said anterior portion of said body, in turn, further comprising;

stabilizer means for exerting forces from the shelf onto the shelf side of the standard, said stabilizer means dimensioned for the free end thereof, with the shelf in the second position, to coact with another one of said predetermined openings and provide additional stability to the shelf;

said posterior portion of said body, in turn, further comprising;

two or more wire clip means serially connected to said stabilizer means, said wire clip means and said stabilizer means having the longitudinal axes thereof substantially coplanar, each wire clip means having a load-bearing portion and a descender portion connected at substantially right angles the one to the other and, when installed, the load-bearing portion of the selected wire clip means rests upon the lower edge of the opening and the descender abuts the rear thereof, said two or more clip means providing at the juncture thereof a predetermined selected angle for a corresponding angular difference between adjacent shelf positions;

whereby to change the mounting position of the shelf, no disassembly and subsequent reassembly is required.

2. An attaching device as described in claim 1, wherein said clip means is comprised of first and second wire clip means with the load-bearing portion of said first wire clip means attached to said stabilizer means and the load-bearing portion of said second wire clip means attached to the descender portion of said first wire clip means.

3. An attaching device as described in claim 2, wherein the juncture between said first and said second wire clip means is selected to be at an angle between 102 and 112 degrees for a corresponding angular difference between a first and a second shelf position of between 12 and 22 degrees.

4. An attaching device as described in claim 3, wherein the juncture between said first and said wire second clip means is selected to be at an angle of substantially 107 degrees for a corresponding angular difference between a first and a second shelf position of substantially 17 degrees.

5. An attaching device as described in claim 1, wherein said wire formative is square in the cross-sectional aspect thereof.

6. An attaching device as described in claim 5, wherein said wire formative is dimensioned with an envelope about the wire clip means thereof having an altitude within the dimensions of said opening so that the draft required the wire formative is less than the opening.

7. A multiposition shelf assembly for a display unit, said multiposition shelf assembly adjustably mounted thereto in any one of at least two positions onto a substantially vertical support surface, said support surface having a face plane with predetermined openings therethrough, said multiposition shelf assembly comprising, in combination:

a wire mounting device attached to shelf, which, when viewed with the shelf installed to said display unit, on one side of and substantially normal to said face plane having an anterior portion on the shelf side of the face plane and a posterior portion on the other side, said anterior portion of said mounting device, in turn, further comprising;

stabilizer means for exerting forces from the shelf onto the shelf side of the support surface, said stabilizer means dimensioned for the free end thereof, with the shelf in the second position, to coact with another one of said predetermined openings of said standard and provide additional stability to the shelf; said posterior portion of said mounting device, in turn, further comprising;

two or more clip means serially connected to said stabilizer means, said clip means and said stabilizer means having the longitudinal axes thereof substantially coplanar, each clip means having a load-bearing portion and a descender portion connected at substantially right angles the one to the other and, when installed, the load-bearing portion of the selected clip means rests upon the lower edge of the opening and the descender abuts the rear thereof;

whereby to change the mounting position of the shelf, no disassembly and subsequent reassembly is required.

8. A multiposition shelf assembly as described in claim 7, wherein the juncture between successive clip means is a predetermined selected angle for a corresponding angular difference between adjacent shelf positions.

9. A multiposition shelf assembly as described in claim 7, wherein said clip means is comprised of first and second clip means with the load-bearing portion of said first clip means attached to said stabilizer means and the load-bearing portion of said second clip means attached to the descender portion of said first clip means.

10. A multiposition shelf assembly as described in claim 9, wherein the juncture between said first and said second clip means is a predetermined selected angle for a corresponding angular difference between a first and a second shelf position.

11. A multiposition shelf assembly as described in claim 10, wherein the juncture between said first and said second clip means is selected to be at an angle between 102 and 112 degrees for a corresponding angular difference between a first and a second shelf position of between 12 and 22 degrees.

12. A multiposition shelf assembly as described in claim 11, wherein the juncture between said first and said second clip means is selected to be at an angle of substantially 107 degrees for a corresponding angular difference between a first and a second shelf position of substantially 17 degrees.

13. A multiposition shelf assembly as described in claim 7, wherein said wire mounting device is square in the cross-sectional aspect thereof.

14. A multiposition shelf assembly as described in claim 13, wherein said wire mounting device is dimensioned with an envelope about the clip means thereof having an altitude within the dimensions of said opening so that the draft required the wire form is less than the opening.

15. An attaching device adjustably mounting a display unit shelf in any one of at least two positions onto a substantially vertical support surface, said support surface having a face plane with predetermined openings therethrough, said attaching device comprising, in combination:

a wire formative attached to said shelf, when viewed with the shelf installed on one side of and substantially normal to said face plane, having an anterior portion on the shelf side of the face plane and a posterior portion, on the other side, and extending through one of said predetermined openings, said anterior portion of said body, in turn, further comprising;

stabilizer means for exerting forces from the shelf onto the shelf side of the support standard;

said posterior portion of said body, in turn, further comprising;

two or more wire clip means serially connected to said stabilizer means, said wire clip means and said stabilizer means having the longitudinal axes thereof substantially coplanar, each wire clip means having a load-bearing portion and a descender portion connected at substantially right angles the one to the other and, when installed, the load-bearing portion of the selected wire clip means rests upon the lower edge of the opening and the descender abuts the rear thereof, said two or more clip means providing at the juncture thereof a predetermined selected angle for a corresponding angular difference between adjacent shelf positions;

said wire formative dimensioned with an envelope about the clip means thereof having an altitude within the dimensions of said opening so that the draft required the wire form is less than the opening;

whereby to change the mounting position of the shelf, no disassembly and subsequent reassembly is required.

16. An attaching device as described in claim 15, wherein the juncture between said first and said second clip means is a predetermined selected angle for a corresponding angular difference between a first and a second shelf position.

17. An attaching device as described in claim 16, wherein the juncture between said first and said second clip means is selected to be at an angle between 102 and 112 degrees for a corresponding angular difference between a first and a second shelf position of between 12 and 22 degrees.

18. An attaching device as described in claim 17, wherein the juncture between said first and said second clip means is selected to be at an angle of substantially 107 degrees for a corresponding angular difference between a first and a second shelf position of substantially 17 degrees.

19. An attaching device as described in claim 17, wherein stabilizer means is dimensioned for the free end thereof, with the shelf in the second position, to coact with another one of said openings and thereby provide additional stability to the shelf.

20. An attaching device as described in claim 15, wherein said body is constructed from a wire form which is square in the cross-sectional aspect thereof.

* * * * *